US006467981B1

(12) United States Patent
Gueret

(10) Patent No.: US 6,467,981 B1
(45) Date of Patent: Oct. 22, 2002

(54) APPLICATION FOR A DISPERSIBLE SUBSTANCE, AN ASSEMBLY INCLUDING SUCH AN APPLICATOR, AND A METHOD

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/339,840

(22) Filed: Jun. 25, 1999

(30) Foreign Application Priority Data

Jul. 3, 1998 (FR) ..... 98 08543

(51) Int. Cl.[7] ..... A47K 7/02
(52) U.S. Cl. ..... 401/201; 401/265; 401/88
(58) Field of Search ..... 401/201, 196, 401/200, 88, 261, 265, 266; 132/293–297, 317

(56) References Cited

U.S. PATENT DOCUMENTS

| | | | | |
|---|---|---|---|---|
| 1,524,008 A | | 1/1925 | Anastasia | |
| 1,899,386 A | | 2/1933 | Flosi | |
| 2,450,919 A | | 10/1948 | Runnels | 15/131.1 |
| 2,930,384 A | | 3/1960 | Strain et al. | |
| 3,488,126 A | * | 1/1970 | Avallone | 401/201 |
| 3,775,014 A | * | 11/1973 | Rosborne | 401/8 |
| 3,947,971 A | * | 4/1976 | Bauer | 401/201 |
| 4,665,901 A | | 5/1987 | Spector | |
| 4,935,158 A | * | 6/1990 | Aszman et al. | 401/201 |
| 4,969,225 A | * | 11/1990 | Schubert | 401/201 |
| 4,983,061 A | | 1/1991 | Demarest | |
| 5,131,773 A | | 7/1992 | Gueret | 401/68 |
| 5,904,151 A | | 5/1999 | Gueret | 132/293 |
| 6,082,919 A | | 7/2000 | de Laforcade | 401/190 |

FOREIGN PATENT DOCUMENTS

| | | |
|---|---|---|
| EP | 0 775 647 A1 | 5/1997 |
| FR | 782 500 | 6/1935 |
| FR | 1 272 557 | 8/1961 |
| FR | 2 601 865 A1 | 1/1988 |
| FR | 2 642 675 | 8/1990 |
| FR | 2 754 985 A1 | 4/1998 |
| GB | 626797 | 7/1949 |

* cited by examiner

*Primary Examiner*—David J. Walczak
(74) *Attorney, Agent, or Firm*—Finnegan, Henderson, Farabow, Garrett & Dunner, L.L.P.

(57) ABSTRACT

An applicator for applying a dispersible substance to the skin, the applicator comprising: a housing opening out in a face of the applicator for putting into contact with the skin to apply the substance; a supply of substance contained within the housing, the supply of substance and the housing being shaped in such a manner that the substance can come directly into contact with the skin during application; and a porous material suitable for retaining a liquid and for giving it back directly onto the supply of substance and also onto the face of the applicator that is bought into contact with the skin during application of the substance, the substance being suitable for dispersing on contact with the liquid released by the porous material.

29 Claims, 5 Drawing Sheets

FIG_11
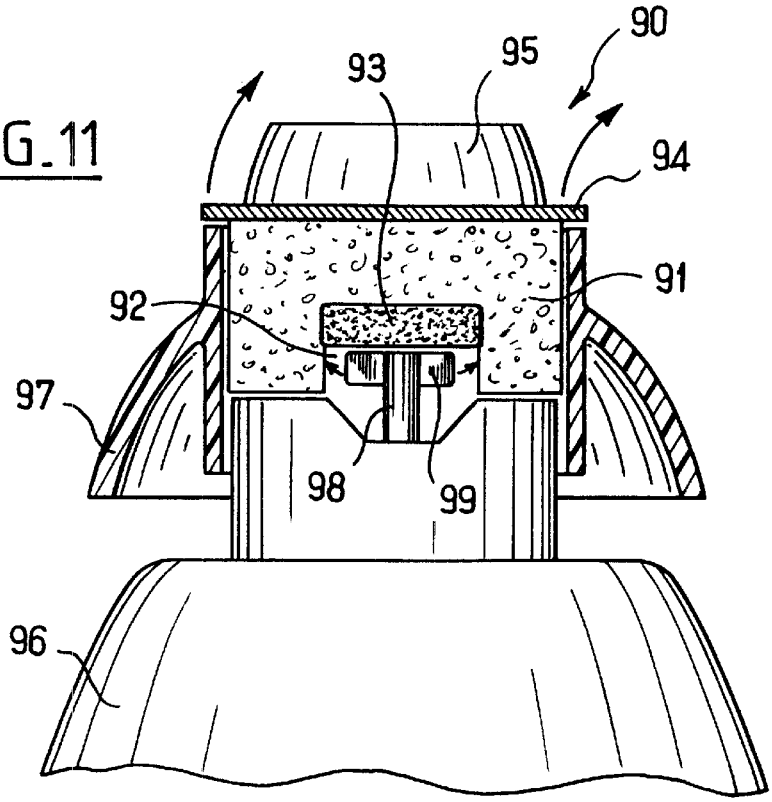
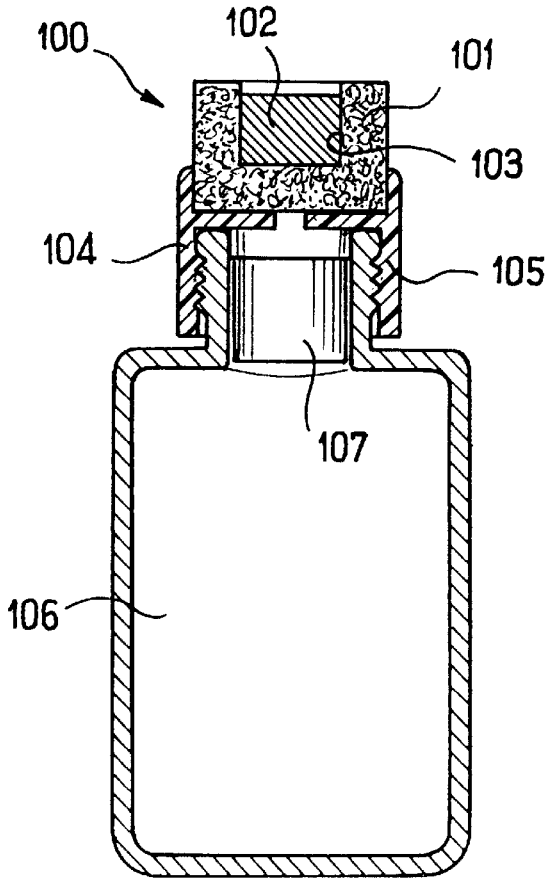
FIG_12

APPLICATION FOR A DISPERSIBLE SUBSTANCE, AN ASSEMBLY INCLUDING SUCH AN APPLICATOR, AND A METHOD

The present invention relates to applying a cosmetic and/or skin treatment substance on the skin, and more particularly, but not exclusively, a dispersible substance that is obtained by extrusion and/or compacting and that needs to be packaged dry, e.g. in order to preserve it.

BACKGROUND OF THE INVENTION

U.S. Pat. No. 1,524,008 discloses a sponge housing a bar of soap which has a free face that can be bought into contact with the skin.

An impermeable barrier separates the soap from the sponge in order to enable the soap to retain a solid consistency.

OBJECTS AND SUMMARY OF THE INVENTION

The invention seeks to enable a dispersible substance to be applied in uniform manner under conditions of satisfactory hygiene.

The invention also seeks to enable a relatively large quantity of substance to be dispensed on a relatively small area, should that be necessary, e.g. for the purpose of treating the face.

The invention achieves this by means of an applicator comprising:

- a housing opening out in a face of the applicator for putting into contact with the skin to apply the substance;
- a supply of substance contained within said housing, said supply of substance and said housing being shaped in such a manner that the substance can come directly into contact with the skin during application; and
- a porous material suitable for retaining a liquid and for giving it back directly onto the supply of substance and also onto the face of the applicator that is bought into contact with the skin during application of the substance, the substance being suitable for dispersing on contact with the liquid released by the porous material.

Once the applicator has been filled with the liquid that is used for dispersing the substance contained in the above-mentioned housing, e.g. water, it is moved over the skin to moisten it and to enable the substance contained in the applicator to disperse on contact therewith.

By means of the invention, the user can easily apply the substance in the desired manner, e.g. in the form of a foam, a mask, or a film-forming coating.

The substance applied in this way is capable of exercising various effects on the skin, for example whitening it, exfoliating it, or indeed cleansing it.

In all cases, the dispersible substance of the present invention is a substance which is used in close relationship with the liquid that is released during application by the porous material, which is not true of the applicator described in French patent application FR-A-2 754 985 which is used in the dry state.

Whereas in above-mentioned U.S. Pat. No. 1,524,008, the water contained in the sponge is prevented from coming directly into contact with the soap because of the existence of the impermeable barrier, in the present invention the liquid impregnating the porous material is capable of being released not only on the skin, but also onto the supply of substance, thereby favoring dispersal thereof.

The supply of substance is preferably used during a single use only, so that if any substance remains at the end of use in the dispersed state in the housing of the applicator, that is of no consequence for the next use which takes place using a new applicator or with a new supply of substance, after the applicator has been cleaned.

In a particular embodiment, the housing of the applicator for containing the dispersible substance is off-center, thereby making the applicator easier to use and making it easy for the user to determine the quantity of substance that is deposited on the skin by pressing the applicator more or less firmly with the fingertips.

The substance to be applied on the skin can be in the form of a pellet for insertion into said housing, which housing can be in the form of an outwardly open cavity having a bottom that is larger than its opening.

In general, the applicator preferably includes a portion of smaller diameter than the pellet so as to retain it.

In a variant, the housing can be cylindrical and the substance can be retained therein by friction.

Advantageously, the applicator has an impermeable wall between its face that is to be used for applying the substance and its face that is to be held by the user, thus enabling the user to avoid excessively wetting the fingers during application.

The applicator can have a special element for grasping such as a handle on its face remote from its face that is to be used for applying the substance.

In a variant, the applicator can be hollow and open at one end so as to enable a hand to be engaged therein.

The applicator can also have at least one second housing suitable for containing another substance for applying to the skin, and it can enable two substances to be mixed together at the time of use only.

In a particular embodiment, the applicator is removably secured to a supply containing the liquid that causes the substance to disperse on coming into contact therewith.

The liquid can be fed from the supply onto said porous material by means of a feed member opening out into said housing and including a deflector to avoid discharging the liquid directly onto the substance.

In another particular embodiment, the applicator is fastened on a supply having a deformable wall and fitted with a valve that opens under the pressure of the substance when the user presses against said wall.

The invention also provides an assembly comprising an applicator as specified above and at least one supply of substance packaged separately from the applicator.

The invention also provides a method of applying on the skin a cosmetic that is capable of dispersing on contact with a liquid, the method comprising the steps consisting in:

- introducing a predetermined quantity of substance into the housing of an applicator as specified above, the applicator comprising a porous material capable of absorbing said liquid and of giving it back on contact with the skin during application;
- soaking said porous material with said liquid; and
- moving the applicator in contact with the skin.

BRIEF DESCRIPTION OF THE DRAWINGS

Other characteristics and advantages of the present invention will appear on reading the following detailed description of non-limiting embodiments and on examining the accompanying drawings, in which:

FIG. 11 is a diagrammatic section view of an applicator constituting a ninth embodiment;

FIG. 12 is a diagrammatic section view of an applicator constituting a tenth embodiment.

MORE DETAILED DESCRIPTION

Figure 1:
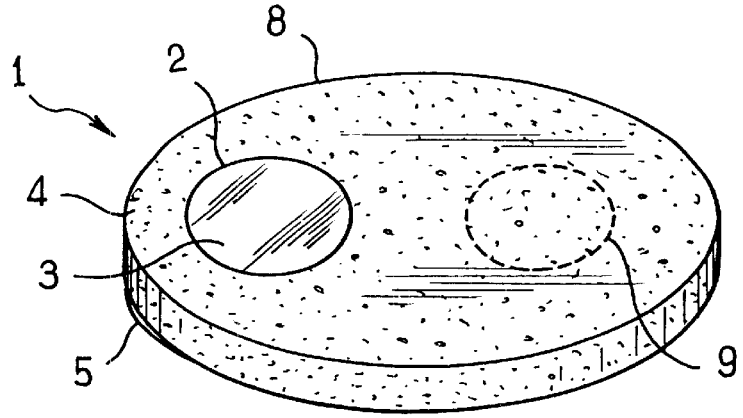
FIG. 1 is a diagrammatic perspective view of an applicator constituting a first embodiment.
Figure 2:
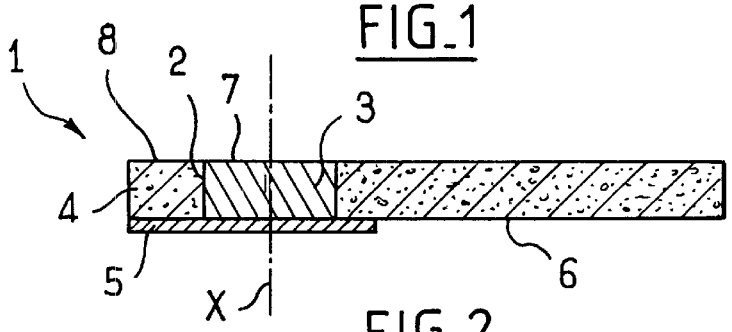
FIG. 2 is a diagrammatic section view on a median plane of symmetry of the FIG. 1 applicator.

The applicator 1 shown in FIGS. 1 and 2 includes a housing 2 containing a supply of substance, which supply is in the form of a single-use pellet 3.

In a variant, the supply of substance could also be in the form of a cube or in some other form that is not circularly cylindrical.

In the example shown, the housing 2 is circularly cylindrical about an axis X and it is made by being cut out in a support 4 constituted by a relatively thick layer of an open-celled foam.

In a variant, the support 4 could be constituted by any other porous material capable of absorbing water and of giving it back during application.

The outline of the support 4 is substantially elliptical as can be seen in FIG. 1, with the axis X of the housing 2 being off-center.

The housing 2 is closed at its bottom end by a wall 5 fitted on a face 6 of the support 4, as shown in FIG. 2.

The opposite face of the applicator, given reference 8, is designed to come into contact with the skin while the substance is being applied.

In the example described, the thickness of the pellet 2 is substantially the same as the thickness of the support 4, such that the outside face 7 of the pellet 3 is situated substantially flush with the face 8 of the applicator.

The nominal diameter of the housing 2 is slightly smaller than the diameter of the pellet 3 so that the pellet 3 is held therein by friction.

The pellet 3 is directly in contact with the material constituting the support 4.

The wall 5 which is preferably constituted by an impermeable material is fixed on the support 4 by any conventional means such as heat-sealing, adhesive, or stitching.

To use the applicator 1, the user soaks the support 4 with water, inserts the pellet 3, and brings its face 7 together with the face 8 of the applicator into contact with the skin.

For example, while holding the applicator between the thumb and the middle finger, the user moves the applicator over the skin while performing small circular movements, thereby moistening the skin and the face 7 of the pellet 3 which is thus dispersed progressively in contact with the skin, e.g. to form a foam.

Throughout application, the user can determine the quantity of substance and/or of water which is applied by pressing the applicator more or less vigorously against the skin, and in particular by pressing against the wall 5 with the index finger.

Water is delivered into the housing 2 in contact with the pellet 3, thereby accelerating the dispersion thereof.

In a variant, the applicator has a second housing 9 represented by dashed lines in FIG. 1, to contain a second pellet of a substance that needs to be stored separately and for mixing with the substance constituting the pellet 3, but only during application.

It is thus possible to house in a single applicator both a pellet containing citric acid and a pellet containing bicarbonate of soda, for example, with the mixing of these two substances during application giving rise to effervescence, which can improve foaming and/or penetration of active agents and/or can give the user a sensation of freshness.

Without going beyond the ambit of the present invention, the face 8 of the support 4 could include a covering of woven, non-woven, or flocked fabric, e.g. for the purpose of increasing user comfort.

Figure 3:
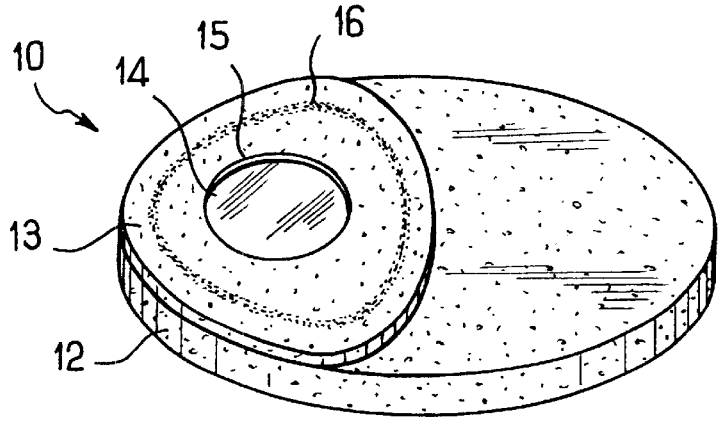
FIG. 3 is a diagrammatic perspective view of an applicator constituting a second embodiment.
Figure 4:
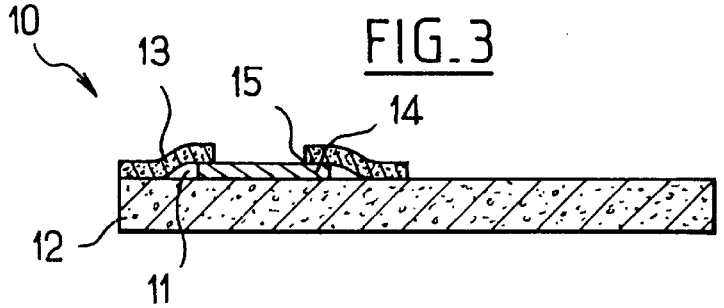
FIG. 4 is a diagrammatic section view on a median plane of symmetry of the FIG. 3 applicator.

The applicator 10 shown in FIGS. 3 and 4 is made by using conventional means to assemble together a support 12 and a holding layer 13, both of which are made of porous materials, e.g. open-celled foams presenting a certain amount of elasticity.

By way of example, FIG. 3 shows an assembly line 16 provided by heat-sealing, where the materials used are thermofusible.

The support 12 is substantially identical in shape to the support 4 as described above, but it does not have a housing 2.

The holding layer 13 is thinner than the support 12 and substantially covers only about half of it, as can be seen in FIGS. 3 and 4.

It is pierced in its center to form an opening 15 into which a pellet of substance 14 can be inserted.

The diameter of the pellet 14 is greater than the diameter of the opening 15.

The pellet 14 can be inserted by elastically deforming the holding layer 13 so as to enlarge the opening 15 sufficiently.

The assembly line 16 is situated far enough away from the opening 15 to enable the pellet 14 to be received beneath the holding layer 13.

After insertion, the pellet 14 is held in the space 11 formed between the support 12 and the holding layer 13.

Once the pellet 14 is in place, to use the applicator 10, it suffices to soak the support 12 and to move the holding layer 13 in contact with the skin.

The water contained in the support 12 diffuses into the holding layer 13 and moistens the skin, thereby enabling the pellet 14 to disperse on coming into contact with the water.

The pellet 14 has one face resting against the support 12 and the liquid contained in the support 12 is thus given directly to the pellet 14, thereby accelerating dispersion thereof.

Figure 5:
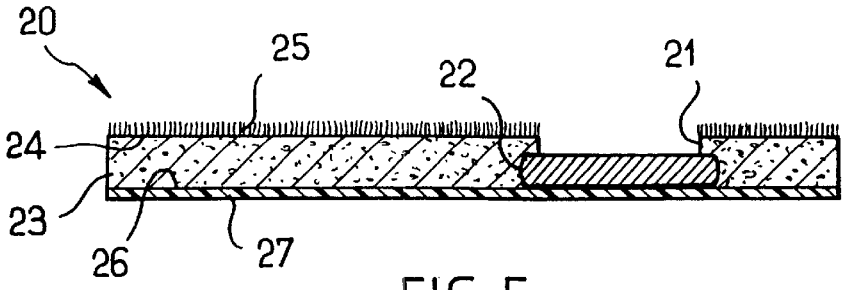
FIG. 5 is a view analogous to FIG. 4, showing a third embodiment.

FIG. 5 shows an applicator 20 having a housing 21 for containing a pellet 22 of substance.

Prior to insertion of the pellet 22, the housing 21 is generally circularly cylindrical in shape, and it is made by being cut out in a support 23 constituted by a relatively thick layer of porous material, e.g. an open celled foam.

On its face 24 that is to be applied to the skin, the support 23 has flocking 25 while on its opposite face 26 it has an impermeable wall 27 which covers it completely and which closes the housing 21 at one end.

The pellet 22 is held in the housing 21 by friction.

The pellet 22 comes directly into contact with the support 23 via its periphery.

The presence of the wall 27 allows the user to avoid wetting the fingers during application, which takes place in a manner analogous to that described above with reference to FIGS. 1 to 4.

The user needs to press sufficiently on the applicator to ensure that the pellet 22 comes into contact with the skin, where necessary.

Figure 6:
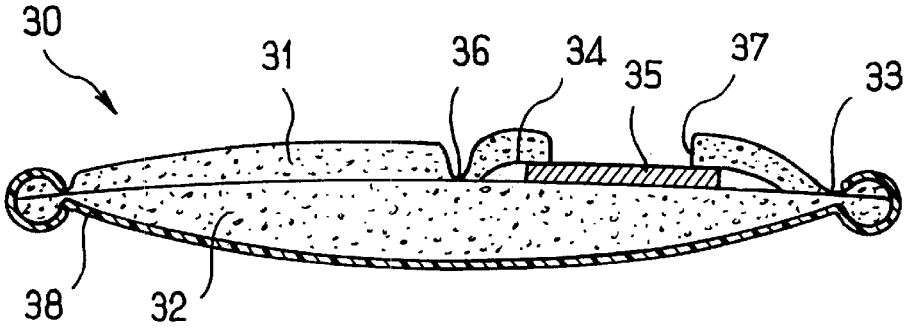
FIG. 6 is a diagrammatic section view on a median plane of symmetry of a fourth embodiment.

The applicator 30 shown in FIG. 6 is made by assembling together two superposed layers 31 and 32 each constituted by a porous material such as an open-celled foam.

In the example described, the layers 31 and 32 are assembled together by heat-sealing at their periphery at 33, and also by heat-sealing around a circular opening 37 formed in the layer 31.

The layers 31 and 32 can be spaced apart from each other in the vicinity of the opening 37 so as to constitute a housing 34 suitable for receiving a pellet of substance 35.

The diameter of the opening 37 is smaller than the diameter of the pellet 35, so that the pellet remains held captive in the housing 34 once it has been inserted therein.

The layer 32 is covered on its outside face by an impermeable wall 38 which is assembled to the layers 31 and 32 by heat-sealing at 33.

The pellet 35 has one face resting on the layer 32.

Figure 7:
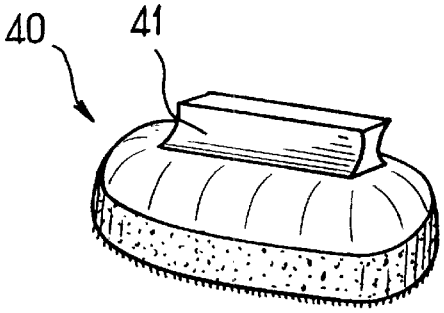
FIG. 7 is a diagrammatic perspective view of an applicator constituting a fifth embodiment.

FIG. 7 shows an applicator 40 whose face opposite from its face that is to be applied to the skin is provided with an element 41 for grasping, such as a handle.

This applicator is otherwise substantially similar to the applicator 20 as described above.

Figure 8:
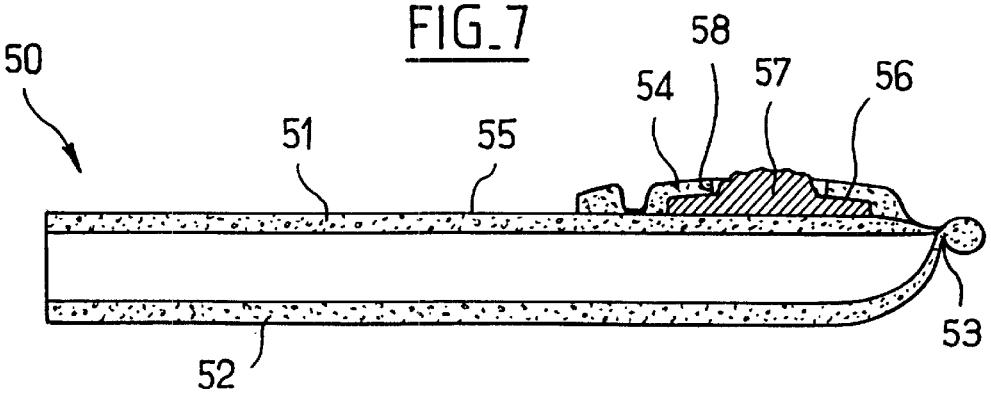
FIG. 8 is a diagrammatic fragmentary view in section on a median plane of symmetry, of an applicator constituting a sixth embodiment.

FIG. 8 shows an applicator 50 comprising two layers 51 and 52 constituted by porous material, e.g. an open-celled foam.

The layers 51 and 52 are assembled together at their periphery at 53 while leaving an opening on one side to enable the user to insert a hand or several fingers between them.

A holding piece 54 is fixed by heat-sealing for example on the outside face 55 of the layer 51 so as to constitute a housing 56 for receiving a supply of substance 57.

In this example, the substance is inserted into the housing 56 in the form of a paste which passes through an opening 58 in the holding piece 54, which holding piece is made of a porous material.

The substance 57 is directly in contact with the layer 51.

The applicator 50 is used by wetting the layers 51 and 52 and then inserting the hand or several fingers between the layers and subsequently moving the holding piece 54 and possibly also the layer 51 in contact with the skin.

The water-containing layer 51 constitutes a supply of water for moistening the skin so that the substance 57 disperses on coming into contact therewith.

Figure 9:
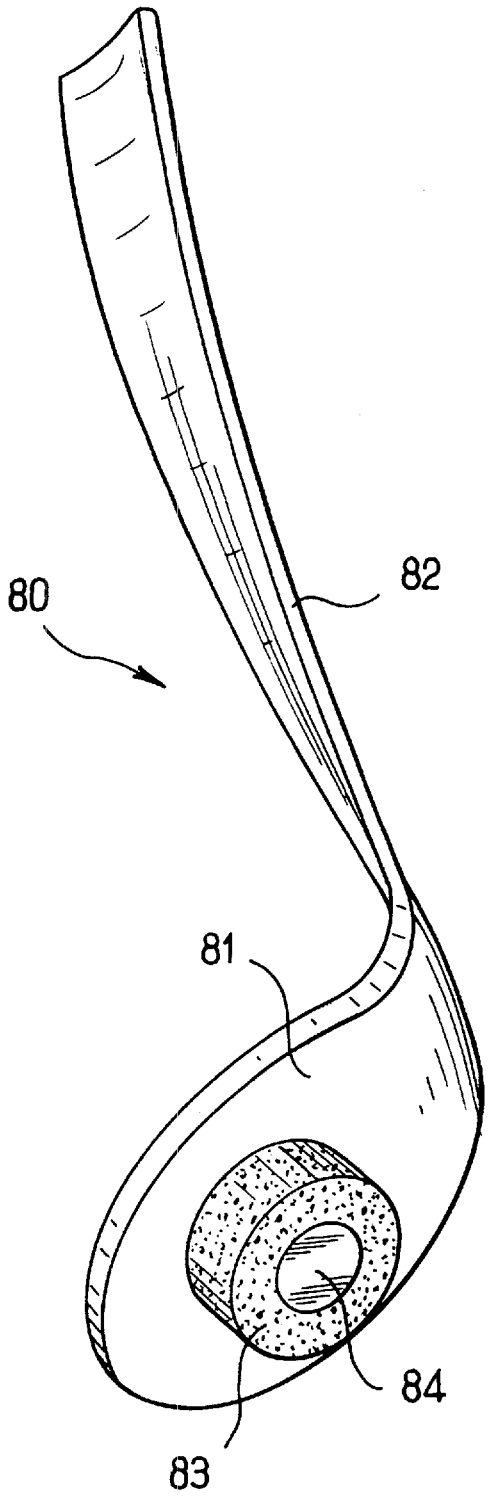
FIG. 9 is a diagrammatic perspective view of an applicator constituting a seventh embodiment.

FIG. 9 shows an applicator 80 constituting another embodiment of the invention.

This applicator 80 comprises a support 83 of porous material such as an open-celled foam, and it is provided in its center with a housing for retaining a pellet 84 of a substance that is to be applied to the skin.

The pellet 84 is thus directly in contact with the material constituting the support 83.

The support 83 is fixed on a spatula 81 of rigid plastics material which is extended by a handle 82.

Figure 10:
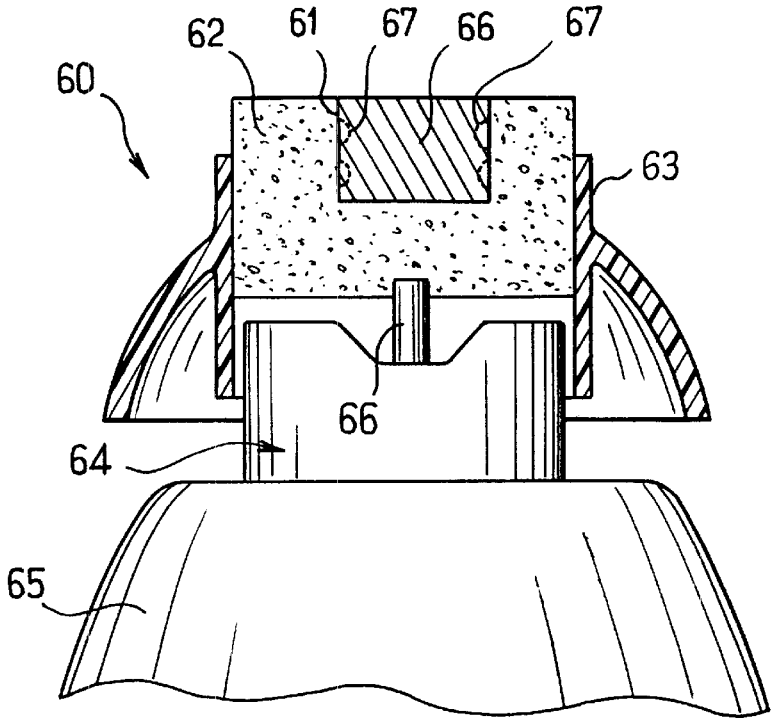
FIG. 10 is a diagrammatic section view of an applicator constituting an eighth embodiment.

FIG. 10 shows an applicator 60 constituting another embodiment of the invention.

This applicator 60 has a housing 61 made in a block 62 of porous material which is secured to a support 63 forming a portion of a device 64 for feeding a liquid.

The device 64 comprises a receptacle 65 containing the liquid, which may for example be water containing active substances that have an effect on the skin, and dispenser means 66 which may be operates, for example, by depressing the support 63, e.g. when the applicator 60 is pressed against the skin.

The dispenser means 66 serve to inject the liquid that is contained in the receptacle directly into the block 62.

The housing 61 contains a supply of substance in the form of a pellet 66 that is held therein by force, the liquid contained in the receptacle 65 being selected to ensure that the substance constituting the pellet 61 disperses on coming into contact with the liquid.

Appropriately shaped portions in relief 67 can be formed in the housing 61 as shown diagrammatically to reinforce retention of the pellet 66.

FIG. 11 shows an applicator 90 comprising a block of porous material 91 provided in its center and in its bottom face with a housing 92 having a pellet 93 of the substance that is to be applied pressed against its end wall.

The top face of the block 91 is fixed to a support 94 that is provided with a handle 95.

The substance constituting the pellet 93 is designed to disperse when it comes into contact with a liquid contained in a tank 96.

In order to be recharged with liquid, the block 91 is inserted in a cup 97 which serves to actuate a dispensing valve represented in the drawing solely by means of the member 98 for delivering liquid to the porous material constituting the block 91.

This member 98 opens out into the housing 62 and has a deflector 99 enabling the liquid to be discharged against the side wall of the housing 92 and preventing the liquid being applied directly to the pellet 93.

Before application to the skin, the user presses down on the cup 97 while the applicator 90 is in place therein, thereby causing a quantity of liquid to be dispensed and the block 91 to be moistened.

Thereafter, the user can take hold of the handle 95 and pass the block 91 over the skin, bringing the pellet 93 into contact therewith.

The pellet 93 disperses on contact with the liquid that is left on the skin by the block 91.

FIG. 12 shows an applicator 100 comprising a block 101 of porous material and a supply of substance 102 contained in a housing 103.

The block 101 is fixed on a support 104 of rigid plastics material which is screwed onto the neck 105 of a receptacle 106 that has a deformable wall and that contains the liquid which is used to disperse the substance 102.

A valve 107 is mounted in the neck of the receptacle to ensure that the liquid is delivered to the block 101 only when the user presses against the deformable wall of the receptacle 106.

An applicator of the invention, e.g. the applicator described with reference to FIGS. 1 to 12 is advantageously put on sale together with a plurality of supplies of substance, each supply of substance corresponding to a single use.

Figure 13:
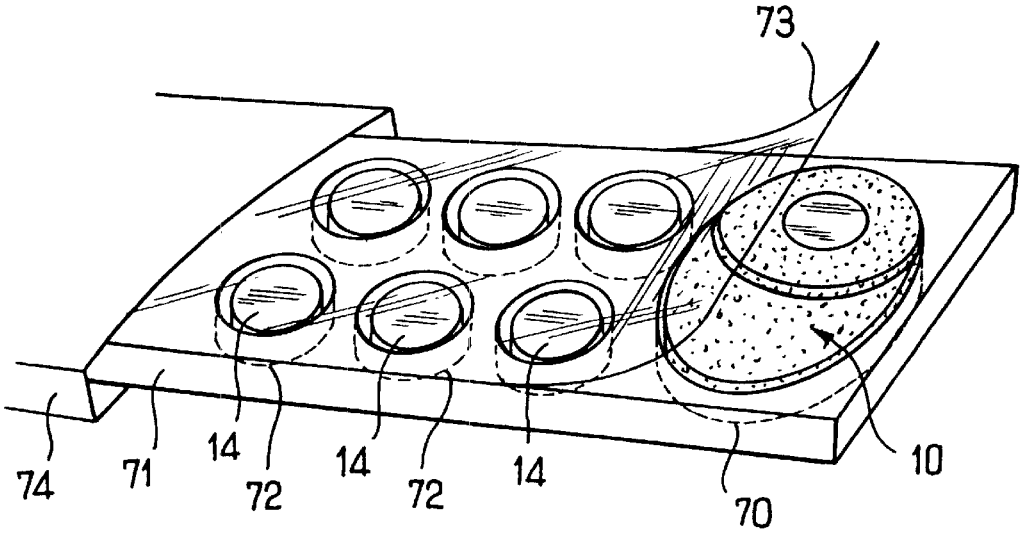
FIG. 13 is a fragmentary diagrammatic view in perspective of an assembly constituted by the applicator shown in FIG. 3 and by supplies of substance.

For example, FIG. 13 shows a plurality of pellets 14, contained in the housings 72 of a tray 71, the applicator being contained in a separate housing 70, and the assembly being protected during storage by a removable protective film 73. The tray 71 is housed in a box 74.

Naturally, the invention is not limited to the embodiments described above.

In particular, without going beyond the ambit of the present invention, it is possible to combine the various particular features of each of the embodiments described with reference to the figures.

Specifically, the face of the applicator that is to come into contact with the skin can be provided with a covering for the purpose of increasing user comfort, for example a covering of flocked cloth.

What is claimed is:

1. An applicator for applying a dispersible substance to the skin, the applicator comprising:

a housing opening out in a face of the applicator for putting into contact with the skin to apply the substance;

a supply of substance contained within said housing, said supply of substance and said housing being shaped in such a manner that the substance can come directly into contact with the skin during application; and a porous material suitable for retaining a liquid and for releasing the liquid onto the supply of substance and also onto said face during application of the substance, the substance being suitable for dispersing on contact with the liquid released by the porous material, the retention of the substance in said housing being, at least prior to the first use ensured essentially by a cooperation of said supply of substance with said housing, wherein said applicator has a substantially uninterrupted planar impermeable wall.

2. An applicator for applying a dispersible substance to the skin, the applicator comprising:

a housing opening out in a face of the applicator to be put into contact with the skin, said face being covered by a flocking;

a supply of substance contained within said housing, said supply of substance and said housing being shaped in such a manner that the substance can come directly into contact with the skin during application; and a porous material suitable for retaining a liquid and for releasing the liquid onto the supply of substance and also onto said face during application of the substance, the substance being suitable for dispersing on contact with the liquid released by the porous material.

3. An applicator for applying a dispersible substance to the skin, the applicator comprising:

a housing opening out in a face of the applicator to be put into contact with the skin;

a supply of substance contained within said housing, said supply of substance and said housing being shaped in such a manner that the substance can come directly into contact with the skin during application; and a porous material suitable for retaining a liquid and for releasing the liquid onto the supply of substance and also onto said face during application of the substance, the substance being suitable for dispersing on contact with the liquid released by the porous material, wherein said housing opens out on a further face through an opening, said opening being closed by an impermeable wall fixed on said porous material and contacting the supply of substance.

4. An applicator for applying a dispersible substance to the skin, the applicator comprising:

a housing opening out in a face of the applicator to be put into contact with the skin;

a supply of substance contained within said housing, said supply of substance and said housing being shaped in such a manner that the substance can come directly into contact with the skin during application; and a porous material suitable for retaining a liquid and for releasing the liquid onto the supply of substance and also onto said face during application of the substance, the substance being suitable for dispersing on contact with the liquid released by the porous material; and means for providing a dry surface during use of the applicator, the means for providing a dry surface comprising a substantially planar impermeable wall attached to the porous material.

5. The applicator according to claim 4, wherein said impermeable wall defines a face of the applicator opposite to the face for putting into contact with the skin.

6. An applicator for applying a dispersible substance to the skin, the applicator comprising:

a supply of dispersible substance intended to be applied to the skin; and a porous material for retaining and releasing a liquid, the porous material comprising a face for contacting the skin during application of the dispersible substance, an opening in the face of the porous material, a housing defined by at least a portion of the porous material, the housing being in communication with the opening in the face of the porous material, and means for retaining the supply of the dispersible substance in the housing, the means for retaining comprising at least substantially the portion of the porous material defining the housing.

7. An applicator for applying a dispersible substance to the skin, the applicator comprising:

a supply of dispersible substance intended to be applied to the skin;

a porous material for retaining and releasing a liquid, the porous material comprising a face for contacting the skin during application of the dispersible substance, an opening in the face of the porous material, and a housing defined by at least a portion of the porous material, the housing being in communication with the opening in the face of the porous material; and a flocking provided on the face of the porous material for increasing comfort as the applicator contacts the skin.

8. An applicator for applying a dispersible substance to the skin, the applicator comprising:

a supply of dispersible substance intended to be applied to the skin;

a porous material for retaining and releasing a liquid, the porous material comprising a face for contacting the skin during application of the dispersible substance, an opening in the face of the porous material, a housing defined by at least a portion of the porous material, the housing being in communication with the opening in the face of the porous material, and a back surface located on a surface of the porous material opposite the face; and an uninterrupted impermeable wall provided on the back surface of the porous material, wherein the uninterrupted impermeable wall is configured to prevent liquid from releasing through the back surface during application of the dispersible substance.

9. An applicator for applying a dispersible substance to the skin, the applicator comprising:

a supply of dispersible substance intended to be applied to the skin; and a porous material for retaining and releasing a liquid, the porous material comprising a face for contacting the skin during application of the dispersible substance, an opening in the face of the porous material, the opening being positioned off-center with respect to the face of the porous material, and a housing defined by at least a portion of the porous material, the housing being in communication with the opening in the face of the porous material.

10. An applicator for applying a dispersible substance to the skin, the applicator comprising:

a supply of dispersible substance intended to be applied to the skin;

a porous material for retaining and releasing a liquid, the porous material comprising a substantially planar layer defining a face and a back surface, an opening in the face of the porous material, and a housing defined by at least a portion of the porous material, the housing being in communication with the opening in the face of the porous material; and a substantially planar impermeable wall being substantially coextensive with the back surface of the porous material, wherein the impermeable wall is configured to prevent liquid from releasing through the back surface during application of the dispersible substance.

11. A method for applying a dispersible substance to the skin, the method comprising:

providing the applicator of claim 6;

moistening the porous material with a liquid; and contacting the skin with the face of the applicator, thereby applying the dispersible substance onto the skin.

12. An assembly for applying a supply of a dispersible substance, the assembly comprising:

the applicator of claim 6; and a package containing a plurality of dispersible substance supplies each configured to be loaded in the housing of the applicator.

13. The applicator of claim 6, wherein the supply of the dispersible substance defines a pellet.

14. The applicator of claim 13, wherein the pellet defines a single use supply of the dispersible substance.

15. The applicator of claim 13, wherein the housing defines a cylinder-shaped cavity.

16. The applicator of claim 15, wherein the pellet defines a diameter, and the cylinder-shaped cavity defines a diameter smaller than the diameter of the pellet.

17. The applicator of claim 15, wherein the cylinder-shaped cavity defines a diameter, and the opening in the face of the porous material defines a diameter smaller than the diameter of the cylinder-shaped cavity.

18. The applicator of claim 6, wherein the supply of the dispersible substance defines a cube.

19. The applicator of claim 6, wherein the porous material further comprises a second housing.

20. The applicator of claim 6, wherein the porous material defines a substantially elliptical-shaped outline.

21. The applicator of claim 6, further comprising an impermeable wall, wherein the housing is partially defined by the impermeable wall.

22. The applicator of claim 6, wherein the housing comprises two adjacent layers of porous material.

23. The applicator of claim 6, further comprising a handle attached to a surface of the applicator opposite the face of the porous material.

24. The applicator of claim 23, wherein the handle comprises a hollow member.

25. The applicator of claim 24, wherein the hollow member is defined by two layers of material.

26. The applicator of claim 23, wherein the handle comprises a spatula.

27. The applicator of claim 6, further comprising a device for supplying the liquid to the applicator.

28. The applicator of claim 27, wherein the device for supplying liquid to the applicator comprises a receptacle for containing the liquid.

29. A method for applying a dispersible substance to the skin, the method comprising:

providing the applicator of claim 28;

moistening the porous material with the liquid from the receptacle; and contacting the skin with the face of the applicator, thereby applying the dispersible substance onto the skin.

* * * * *